US012553435B2

(12) United States Patent
Bihler

(10) Patent No.: US 12,553,435 B2
(45) Date of Patent: Feb. 17, 2026

(54) TENSIONING DEVICE FOR A SCROLL COMPRESSOR

(71) Applicant: Schwäbische Werkzeugmaschinen GmbH, Schramberg-Waldmössingen (DE)

(72) Inventor: Oliver Bihler, Boessingen (DE)

(73) Assignee: SCHWÄBISCHE WERKZEUGMASCHINEN GMBH, Schramberg-Waldmössingen (DE)

( * ) Notice: Subject to any disclaimer, the term of this patent is extended or adjusted under 35 U.S.C. 154(b) by 0 days.

(21) Appl. No.: 18/896,307

(22) Filed: Sep. 25, 2024

(65) Prior Publication Data

US 2025/0101980 A1 Mar. 27, 2025

(30) Foreign Application Priority Data

Sep. 25, 2023 (EP) ..... 23199559

(51) Int. Cl.
*F04C 15/00* (2006.01)
*F04C 2/02* (2006.01)

(52) U.S. Cl.
CPC ..... *F04C 15/00* (2013.01); *F04C 2/025* (2013.01)

(58) Field of Classification Search
CPC ..... F04C 15/00; F04C 2/025
See application file for complete search history.

(56) References Cited

U.S. PATENT DOCUMENTS

2021/0252609 A1* 8/2021 Schäperkötter ..... B24B 13/005

FOREIGN PATENT DOCUMENTS

| | | |
|---|---|---|
| CN | 102380780 | 3/2012 |
| CN | 213411215 | 6/2021 |
| CN | 115213642 | 10/2022 |
| SU | 764938 | 9/1980 |

OTHER PUBLICATIONS

European Search Report issued in EP 23199559.8, dated Feb. 29, 2024, 4 pages.
European Office Action issued in EP 23199559.8, dated Mar. 13, 2024, 5 pages.

* cited by examiner

*Primary Examiner* — Anthony Ayala Delgado
(74) *Attorney, Agent, or Firm* — HSML P.C.

(57) ABSTRACT

A tensioning device for a scroll compressor having at least one frame which has a continuous opening which extends circularly about a central axis and is surrounded by an inner wall of the frame. At least one tensioning sleeve is arranged in the opening of the frame and has a stop section which runs around the central axis and lies flat against the inner wall of the frame with an outer surface. A tensioning section is included which revolves around the central axis and has a continuous recess which extends circularly around the central axis and is surrounded by an inner surface of the tensioning sleeve. At least one tensioning unit which includes at least one tensioning means is arranged between the tensioning sleeve and the frame and by means of which a force can be built up which is uniformly distributed along the circumferential direction.

15 Claims, 3 Drawing Sheets

TENSIONING DEVICE FOR A SCROLL COMPRESSOR

This application claims the benefit of European application EP23199559.8 filed Sep. 25, 2023, which is incorporated herein by reference.

The invention relates to a tensioning device for a scroll compressor.

Tensioning devices for scroll compressors are known from the state of the art in various embodiments.

Scroll compressors comprise in principle of two moving, interlocking, spiral-shaped components. One of the two scroll compressors is permanently attached to the housing and is known as the "fixed scroll" or "f-scroll". The other scroll compressor is mounted eccentrically on a shaft and is known as the "orbiting scroll" or "o-scroll".

For mechanical processing, the individual scrolls must be tensioned securely and must be orientated in relation to a spatial alignment.

Tensioning concepts are known from the state of the art in which the scrolls, mainly the o-scrolls, comprise of external tensioning grooves into which a tensioning device engages with one or several tensioning bolts or pins, thus tensioning the scrolls centrally and aligning them axially. In this kind of clamping the scrolls can be processed from two sides, meaning they do not need to be re-tensioned.

Furthermore, there are tensioning concepts in which the scrolls have no tensioning grooves and the tensioning device, for example, comprises of a spiral chuck, a hydraulic chuck, a collet chuck or a polygonal chuck. In all the above-mentioned tensioning devices it has proven to be a disadvantage that the scroll can only be processed from one side and the opposite side can only be processed following re-tensioning of the workpiece. This proves to be complex and time-consuming.

SUMMARY

One task of the embodiment of the invention is to propose a tensioning device for a scroll compressor with which the workpiece to be processed is accessible and processable from at least two sides.

This task is solved by designing a tensioning device for a scroll compressor which has at least one frame with a continuous opening running circularly around a central axis. This is surrounded by one of the frame's inner walls with at least one tensioning sleeve arranged in the frame opening with a section surrounding the central axis that lies flat against the frame's inner wall and with an outer surface that corresponds to, in particular is complementary to, the frame's inner wall, and that comprises a tensioning section revolving around the central axis. This tensioning section has a continuous recess running circularly around the central axis, surrounded by an inner surface of the tensioning sleeve on which a workpiece, in particular an f-scroll or o-scroll, is arranged to lie flat, and with at least one tensioning unit that comprises at least one tensioning means that is arranged between the tensioning sleeve and the frame. Through this tensioning unit, a force acting on the tensioning section in the direction of the central axis can be built up and distributed uniformly along the circumferential direction with respect to the central axis, whereby the tensioning section of the tensioning sleeve can, by the force acting on the tensioning section from a basic position where the interior diameter of the recess is at a maximum, be transferred to at least one tensioning position in which the interior diameter of the recess is reduced in relation to the base position.

As the frame has a continuous opening and the tensioning sleeve similarly has a continuous recess, the workpiece clamped in the tensioning sleeve is accessible from both sides. This makes it possible to process the workpiece from both sides without having to re-tension the workpiece.

The workpiece can comprise an f-scroll. By "f-scroll" we mean a fixed scroll of a scroll compressor, a so-called "fixed scroll". The workpiece can also comprise an o-scroll. By an "o-scroll" we mean a component of a scroll compressor that is mounted movably and eccentrically on a shaft. These kind of scrolls are also known as "orbiting scrolls" or "o-scrolls". As the tensioning sleeve lies with the tensioning surface flat against the workpiece and the tensioning section can be transferred from the basic position to at least one tensioning position, the workpiece can be force-fitted or friction-fitted. This means it is not necessary for the workpiece to have recesses, for example in the form of grooves, in order to achieve an additional positive fit. Furthermore, the necessary processing steps can be reduced and the tensioning of workpieces simplified.

In principle the at least one tensioning means of the tensioning unit can be arranged as required between the tensioning sleeve and the frame as long as it can act on the tensioning section of the tensioning sleeve. In order to make the tensioning device compact, it proves to be advantageous if the tensioning sleeve comprises a groove-like cavity that is arranged on the outside of the contact section that runs around the central axis as a whole and that is open in the direction of the frame, whereby the tensioning section limits the cavity on the side facing away from the outer side as a whole or at least in sections and whereby at least one of the at least one tensioning means can be or is arranged in the cavity.

This means that at least one tensioning means on the tensioning unit is embedded as a whole in the tensioning sleeve, whereby the tensioning sleeve forms a type of housing in this case.

In principle, the tensioning section of the tensioning sleeve can be designed in any way as long as it fulfils the technical function of being moving towards the central axis by the tensioning means when the tensioning force is increased. In this case, for example, the tensioning section of the tensioning sleeve can comprise a thin wall section spaced from the contact section by the cavity that is deformed in the direction of the central axis through the increased force from the tensioning means.

In addition or as an alternative to this, in a further development of the tensioning device, it can be provided that the tensioning sleeve comprises at least two material weakening sections that are arranged on both sides of the tensioning section, each between the contact section and the tensioning section and that connect the tensioning section with the contact section, delimiting the cavity between the tensioning section and the contact section and are malleable when the force is built up by the tensioning means.

The material weakening sections lead to increased malleability and easier shifting of the tensioning section towards the central axis. The material weakening sections have a similar technical effect to a film hinge.

The tensioning section can comprise a thin wall area. Furthermore, one embodiment of the tensioning device provides for the tensioning section to be designed as a disc and an inner edge area, which comprises the inner surface, lies against the workpiece for tensioning, an outer edge area that adjoins the cavity, and comprises a disc-shaped intermediate area that is load and force absorbing and that connects the inner edge area with the outer edge area.

By designing the tensioning section in the form of a disc, the inner edge area and outer edge area are spaced apart from each other by the intermediate area. This increases the distance of the clamped workpiece to the contact section of the tensioning sleeve and the frame, which simplifies the processing of the workpiece.

In a further development of the above-mentioned embodiment, embodiments are conceivable in which the intermediate area is designed to be solid or in which the intermediate area comprises multiple support elements that extend, distributed evenly around the central axis, from the inner edge area to the outer edge area, whereby two adjoining support elements, inner edge area and outer edge area surround a free cut that is material-free.

Depending on whether the intermediate area is solid or if it comprises multiple spoke-like support elements, one and the same force, introduced by the tensioning means on the outer edge area into the tensioning section, effects another tensioning force onto the workpiece on the inner edge area of the tensioning section. By forming the intermediate area with a multitude of spoke-like support elements, a higher tensioning force can be exerted on the workpiece than in embodiments in which the intermediate area is solid.

Furthermore, the number and the implementation of multiple spoke-like support elements has an influence on the force transferred to tension the workpiece from the outer edge area towards the inner edge area.

Thus, it is proves to be advantageous in a further development of the embodiment of the support area comprising a multitude of spoke-like support elements if at least one of the multiple spoke-like support elements comprises a cross-section that widens from the inner edge area to the outer edge area in a plane transverse to the central axis, and/or if at least one of the multiple spoke-like support elements comprises a V-type or Y-type cross-section transverse to the central axis that opens to the outside relative to the central axis.

The forming of multiple spoke-like support elements in a V-type or Y-type cross-section enables a 'springing in' and 'springing out' when tensioning and releasing the workpiece. Furthermore, this simplifies adaptation to smaller cross-sections.

This effect can be further improved if at least one of the at least one free cut on a plane transverse to the central axis comprises a rounded cross-section and/or rounded corners.

If the free cuts comprise a rounded cross-section or rounded corners then the lifespan of the tensioning device can be increased. In this case the risk of cracks forming is reduced.

It proves to be advantageous if the contact section, the tensioning section and the material weakening section of the tensioning sleeve form a common, one-piece component and/or if the tensioning sleeve and the frame form two separate or separable components.

If the contact section, the tensioning section and the material weakening sections of the tensioning sleeve form a common, one-piece component, then the tensioning device can be designed with a reduced number of components. If the tensioning sleeve and the frame are two separate or separable components, then the tensioning device can be easily adapted to different tools to be processed by setting a corresponding tensioning sleeve into the frame.

In order to simplify access to the tensioning means in the tensioning unit from outside, it has proven to be advantageous if the frame has a cut-out running transverse or semi-transverse to the central axis that extends from one outer wall of the frame to the inner wall of the frame and opens into the cavity.

In this case it is possible, for example, to create an electrical connection to the outside if the tensioning means of the tensioning unit comprises an electrical, electro-magnetic or magnetic tensioning means. Furthermore, mechanical articulation can also take place via the cut-out if the tensioning means comprises a mechanical tensioning means. Furthermore, a pneumatic or hydraulic connection can be created if the tensioning means works hydraulically or pneumatically.

The tensioning means can work electrically, electro-magnetically, magnetically, mechanically, pneumatically and/or hydraulically and comprise a corresponding tensioning means. In a further development of the last-named embodiment it proves to be advantageous if the tensioning means of the tensioning unit comprises a fluid that can be added via the cut-out in the frame of the cavity and the tensioning unit comprises a pressure build-up means through which the fluid in the cavity can be pressurised, whereby the force acting in the direction of the central axis comprises a compressive force.

In this case the tensioning means works hydraulically or pneumatically. The fluid can comprise a gas or a liquid.

In order to transfer a sufficient force on the tensioning sleeve, the pressure that is built up by the pressure build-up means in the tensioning means comprising a fluid can comprise 50 bar to 200 bar.

In order to seal the cavity in the tensioning sleeve upwards and downwards towards the central axis, one embodiment of the tensioning device comprises at least two sealing means that are each arranged between the contact surface of the tensioning sleeve and the inner wall of the frame, each of which is completely circumferential with respect to the central axis and which, viewed in the direction of the central axis, are spaced apart and arranged on opposite sides with respect to the cavity.

In principle it is conceivable that the tensioning sleeve is pressed into the frame. Simple positioning and removal of the tensioning sleeve can be guaranteed if the tensioning device comprises at least one ring, tyre or disc-like stopping mechanism that is attached to the frame and that protrudes towards the central axis with regard to the inner wall of the frame and limits the movement of the tensioning sleeve along a joint direction running parallel to the central axis, along which the tensioning sleeve can be inserted into the opening of the frame when arranged in the frame, when an end position is reached in which the tensioning sleeve is in contact with the step area.

With the disc-like stopping mechanism the tensioning sleeve can be easily inserted along the joint direction into the opening of the frame. In the position arranged in the frame, the tensioning sleeve then lies against the stopping mechanism and is, preferably arranged in such a way that a cut-out arranged in the frame ends in the cavity of the tensioning means.

In a further development of the last-named embodiment it proves to be advantageous if the tensioning device comprises at least one ring, tyre or disc-like rear gripping mechanism that is detachably fixed or fixed on the frame on the side facing away from the stopping mechanism, extends towards the central axis and overlaps the tensioning sleeve transverse to the central direction at least in sections and grips behind the tensioning sleeve arranged in the frame to prevent movement against the joint direction.

In this way the tensioning sleeve can be fixed to prevent it moving out of the frame opening. Furthermore, the rear gripping mechanism can lie against the tensioning sleeve in such a way that it tensions the tensioning sleeve in the direction of the stopping mechanism. This prevents or at least reduces movement of the tensioning sleeve parallel to the central axis.

Embodiments of the tensioning device are preferred in which the stopping mechanism and/or the rear gripping mechanism are attached to the frame in a removable fashion, particularly using force fit and/or form fit, or in a non-removable fashion, particularly using material, force or form fit.

The tensioning device can be designed with a reduced number of components if the frame and the stopping mechanism form a common, one-piece component.

Further features, details and advantages of the invention are apparent from the appended patent claims, from the diagrammatic representation and from the following description of preferred versions of the tensioning device.

DETAILED DESCRIPTION

Figure 1:
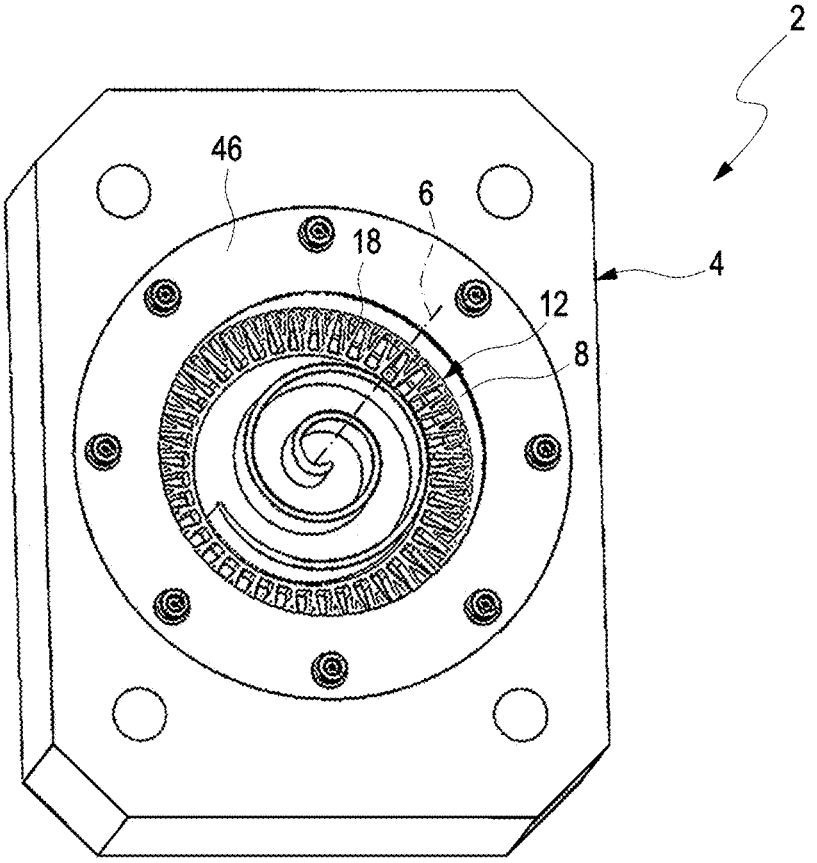
FIG. 1A perspective front view of an exemplary embodiment of the tensioning device.
Figure 2:
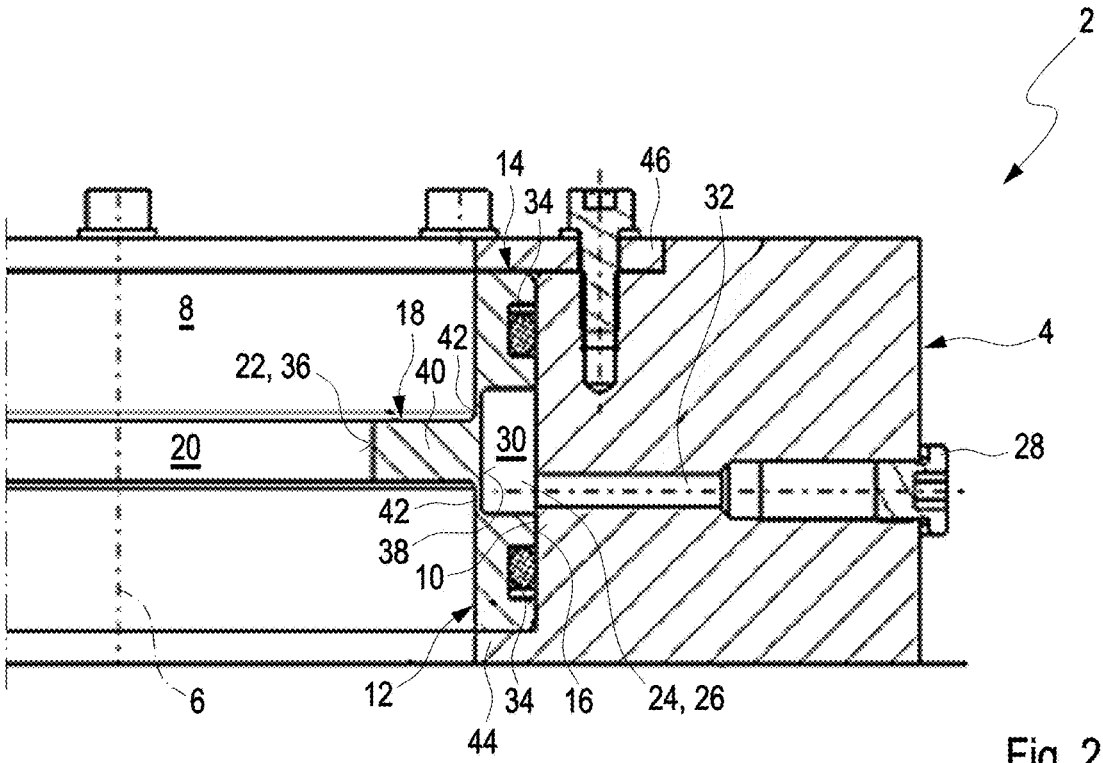
FIG. 2A sectional view of the embodiment example shown in FIG. 1.

The figures show embodiment examples of a tensioning device for a scroll compressor given the overall reference number 2. The tensioning device 2 comprises a frame 4. A continuous opening 8, circularly formed around a central axis 6 is arranged in the frame 4. The opening 8 is surrounded by an inner wall 10 of the frame 4.

A tensioning sleeve 12 is arranged in the opening 8 of the frame 4 of the tensioning device 2. The tensioning sleeve 12 comprises a contact section 14 surrounding the central axis 6, which lies flat against the inner wall 10 of the frame 4 with an outer surface 16 that corresponds to, in particular complements, the inner wall 10 of the frame 4. The tensioning sleeve 12 comprises a tensioning section 18 that surrounds the central axis 6. This comprises a continuous recess 20, arranged running circularly around the central axis 6. The recess 20 is surrounded by an inner surface 22 of the tensioning sleeve 12. A workpiece, in particular an f-scroll or o-scroll, can be placed against the tensioning section 18, in particular against the inner surface 22.

Furthermore, the tensioning device 2 comprises a tensioning unit 24 that comprises at least one tensioning means 26 that is arranged between tensioning sleeve 12 and frame 4. The tensioning means 26 of the tensioning unit 24 can be used to build up a force that is evenly distributed along the circumferential direction with respect to the central axis 6 and acts on the tensioning section 18 in the direction of the central axis 6. As a result of this built-up force, the tensioning section 18 of the tensioning sleeve 12 can be transferred from a basic position, in which the inside diameter of the recess 20 is at a maximum, to at least one tensioning position, in which the inside diameter of the recess 20 is reduced with respect to the basic position.

In the embodiment examples shown in the figures the tensioning means 26 of the tensioning unit 24 is formed by a fluid that can be pressurised via a pressure build-up mechanism 28. For this purpose, the tensioning sleeve 12 comprises a groove-like cavity 30 extending transversely to the central axis 6 in the circumferential direction, which is arranged in the outer side of the contact section 14, which is completely circumferential with respect to the central axis 6 and which is open in the direction of the frame 4. In order to add fluid to the cavity 30 a cut-out 32 is arranged in the frame 4 and is in fluid connection with the cavity 30 and the pressure build-up mechanism 28.

In order to prevent fluid from escaping, the tensioning device 2 comprises two sealing mechanisms 34 that are each arranged between the contact surface 16 of the tensioning sleeve 12 and the inner wall 10 of the frame 4, each of which is completely circumferential with respect to the central axis 6 and which, viewed in the direction of the centre axis 6, are spaced apart and arranged on opposite sides with respect to the cavity 30.

In the embodiment examples shown in the figures for the tensioning device 2, a tensioning section 18 of the tensioning sleeve 12 is designed as a disc. For this purpose, the tensioning section 18 of the tensioning sleeve 12 comprises an inner edge area 36, which comprises the inner surface 22 against which the workpiece rests for tensioning, an outer edge area 38, which adjoins the cavity 30, and a disc-shaped intermediate area 40, which connects the inner edge area 36 to the outer edge area 38 and absorbs the load and force.

The tensioning section 18 of the tensioning sleeve 12 is connected to the contact section 14 of the tensioning sleeve 12 via material weakening sections 42.

In order to fix the tensioning sleeve 12 in the frame 4 against movement parallel to the central axis 6, the tensioning device 2 comprises a stopping mechanism 44 that is attached in the embodiment example show in the figures to the frame 4 and protrudes in the direction of the central axis 6. Stopping mechanism 44 and frame 4 are a one-piece, common component. On the side opposite the stopping mechanism 44 the tensioning device 2 comprises a rear gripping mechanism 46 that is detachable in the embodiment example shown in the figures, namely by means of screwing to the frame 4.

Figure 3:
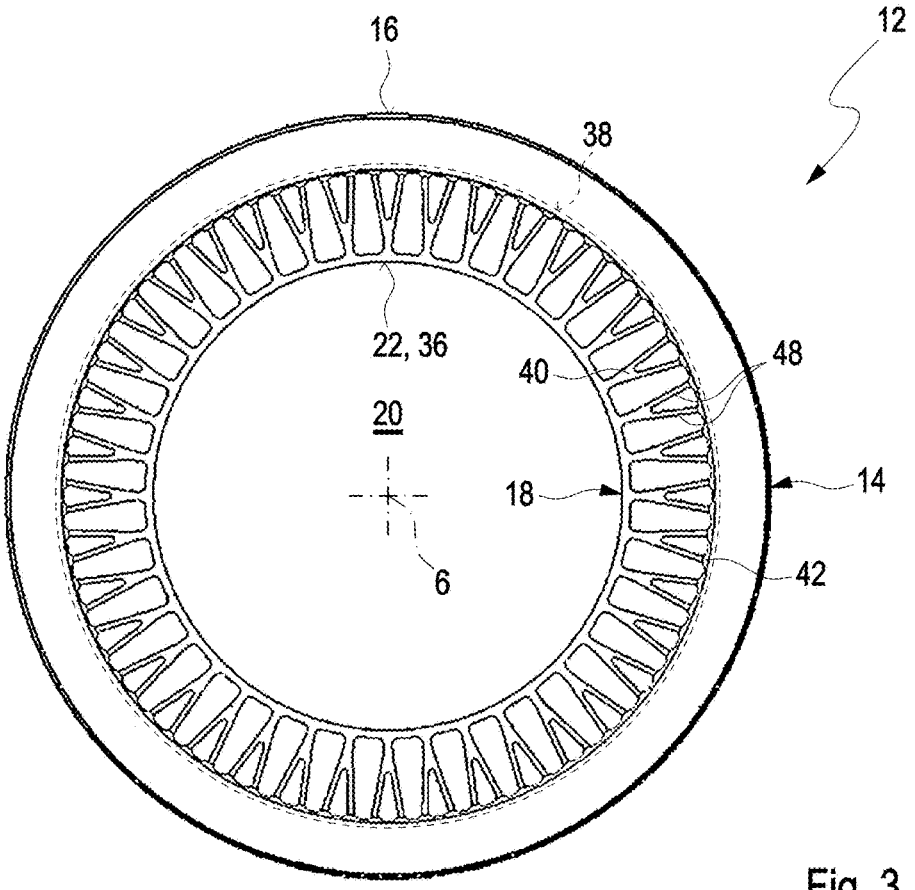
FIG. 3A top view of a tensioning sleeve in the embodiment example shown in FIG. 1

FIG. 3 shows a top view of a tensioning sleeve 12 of a first embodiment example of the tensioning device 2. In this embodiment, the intermediate area 40 is formed by multiple spoke-like support elements 48. These comprise a V-type or Y-type cross section in the embodiment example shown in FIG. 3.

Figure 4:
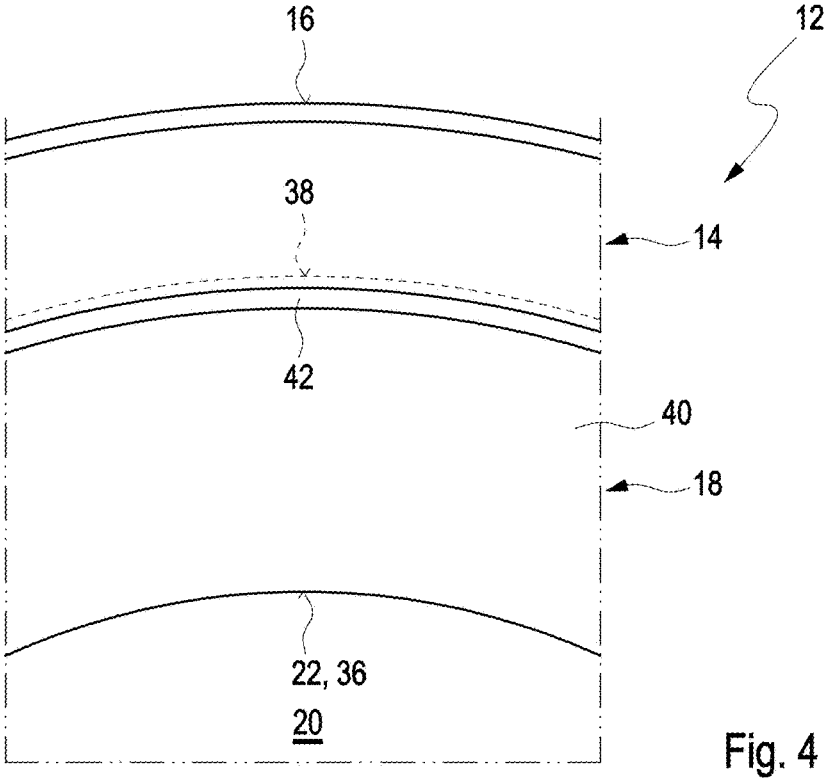
FIG. 4A top view on a sectional view of a tensioning sleeve in a second embodiment example of the tensioning device.

FIG. 4 shows a second embodiment example of the tensioning device 2. In this embodiment, the tensioning sleeve 12 comprises an intermediate area 40 in a solid design.

Figure 5:
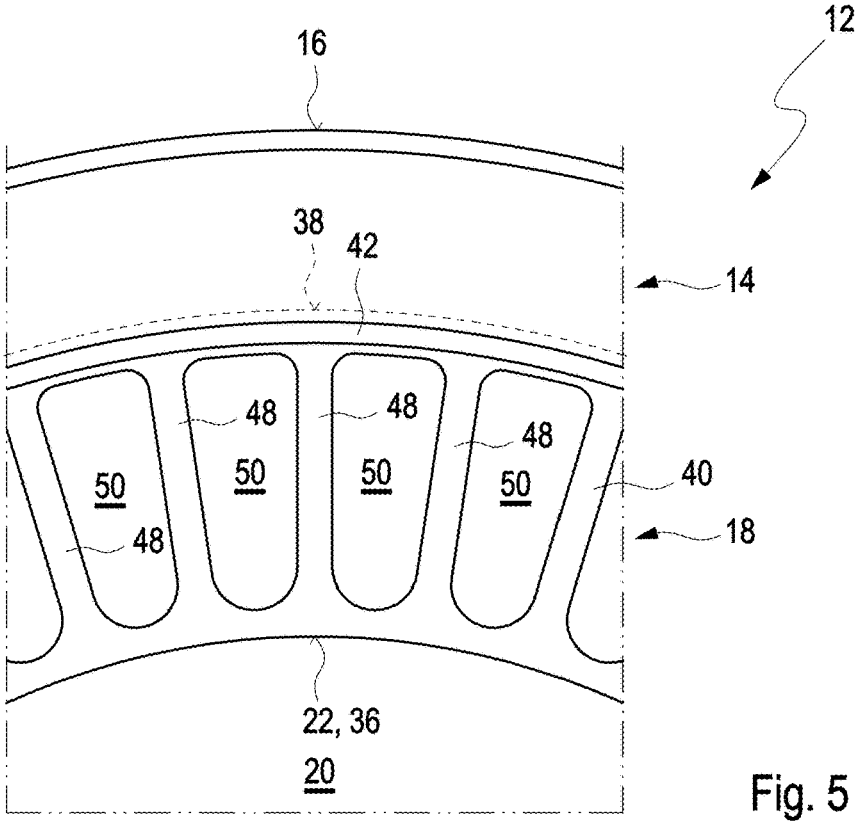
FIG. 5A top view on a sectional view of a tensioning sleeve in a third embodiment example of the tensioning device.

FIG. 5 shows a third embodiment example of the tensioning device 2, in which the tensioning sleeve 12 also comprises an intermediate area 40 with spoke-like support elements 48. However, the support elements 48 are designed in substantially rectilinear fashion. The free cuts 50 arranged between the support elements 48 have a rounded cross-section.

Figure 6:
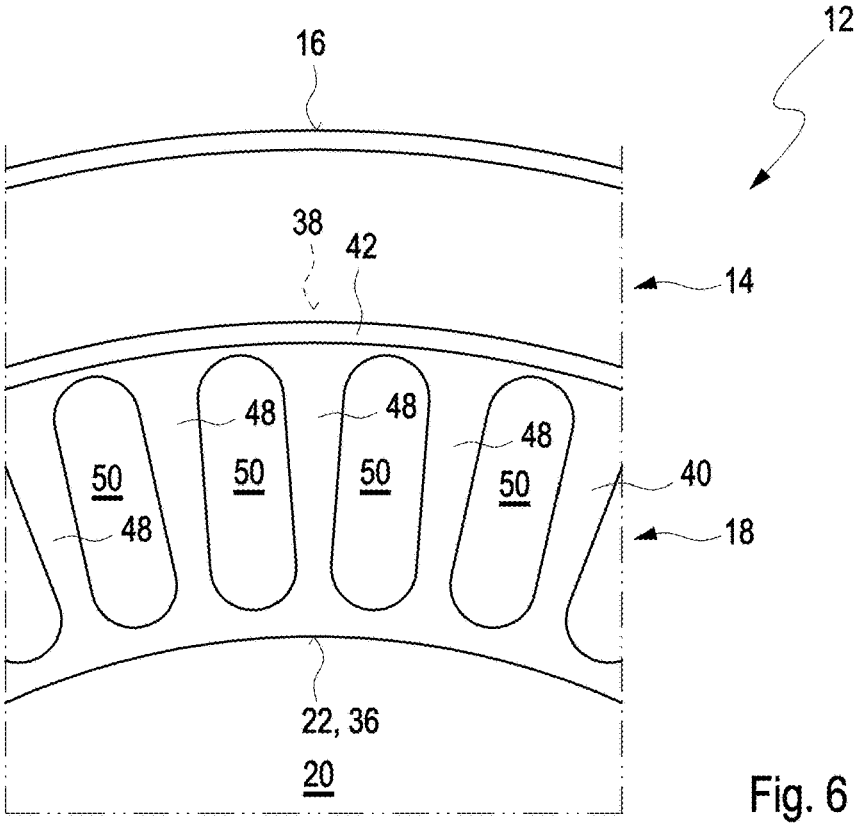
FIG. 6A top view on a sectional view of a tensioning sleeve in a fourth embodiment example of the tensioning device.

FIG. 6 shows a fourth embodiment example of the tensioning device 2, in which the intermediate area 40 comprises spoke-like support elements 48 that extend from the direction of the inner edge area 36 to the outer edge area 38.

In the following, the mode of operation of the tensioning device 2 is briefly described:

This can be tensioned by the tensioning device 2 in order to process a workpiece. For this purpose, a tensioning sleeve 12 is first inserted into the frame 4. This takes place along the joint direction, which runs parallel to the central axis 6. If the tensioning sleeve 12 has reached its target position, then the tensioning sleeve 12 lies against the stopping mechanism 44 of the frame 4. In order to fix the tensioning sleeve 12 the cover-type rear gripping mechanism 46 is screwed onto the frame 4.

According to this, only one workpiece can be arranged in the tensioning sleeve 12 in such a way that the workpiece lies against the inner surface 22 of the tensioning section 18 of the tensioning sleeve 12. In order to tension the workpiece the tensioning means 26 is driven by the tensioning unit 24 in such a way that a force is built up which transfers the tensioning section 18 of the tensioning sleeve 12 from its home position to at least one tensioning position. In the embodiment example shown in the figures the pressure of the fluid that is located in the cavity 30 of the tensioning sleeve 12 is increased in such a way that the tensioning section 18 is pushed in the direction of the central axis 6. A relative movement is made possible through the two material weakening sections 42 that connect the tensioning section 18 with the contact section 14. The workpiece is thus secured with a force fit.

The features of the invention disclosed in the aforementioned description, in the claims as well as in the drawing, both individually and in any combination, may be essential in the realisation of the invention in its various embodiments within the scope of protection of the following claims.

REFERENCE SYMBOL LIST

2 Tensioning device
4 Frame
6 Central axis
8 Opening
10 Inner wall
12 Tensioning sleeve
14 Contact section
16 Outer surface
18 Tensioning section
20 Recess
22 Inner surface
24 Tensioning unit
26 Tensioning device
28 Pressure build-up mechanism
30 Cavity
32 Cut-out
34 Sealing mechanism
36 Inner edge area
38 Outer edge area
40 Intermediate area
42 Material weakening sections
44 Stopping mechanism
46 Rear gripping mechanism
48 Support element
50 Free cut

The invention claimed is:

1. A tensioning device for a scroll compressor with at least one frame, with a continuous opening running in a circle around a central axis, surrounded by an inner wall of the frame with at least one tensioning sleeve arranged in the opening of the frame with a stop section surrounding the central axis that lies flat against the inner wall of the frame with an outer surface that corresponds to the inner wall of the frame, and that comprises a tensioning section revolving around the central axis, which has a continuous recess running in a circle around the central axis that is surrounded by an inner surface of the tensioning sleeve on which a workpiece is arranged to lie flat, and with at least one tensioning unit that comprises at least one tensioning means that is arranged between the tensioning sleeve and the frame and through which a force, distributed evenly along the perimeter direction or the central axis and acting on the tensioning section in the direction of the central axis to be increased, wherein the tensioning section of the tensioning sleeve is configured to, by the force acting on the tensioning section from a basic position where the interior diameter of the recess is at a maximum, be transferred to at least one tensioning position in which the interior diameter of the recess is reduced in relation to the base position.

2. The tensioning device according to claim 1, wherein the tensioning sleeve comprises a groove-like cavity extending transversely to the central axis in the circumferential direction, which is arranged in the outer side of the stop section, which is completely circumferential with respect to the central axis and which is open in the direction of the frame, wherein the tensioning section delimits the cavity as a whole or at least in sections on the side facing away from the outside and whereby at least one of the at least one tensioning means is arranged in the cavity.

3. The tensioning device according to claim 1, wherein the tensioning sleeve comprises at least two material weakening sections which are arranged on both sides of the tensioning section in each case between the stop section and the tensioning section and connect the tensioning section to the stop section, which delimit the cavity between the tensioning section and the stop section and which are malleable when the force is built up by the tensioning means.

4. The tensioning device according to claim 1, wherein the tensioning section is disc-shaped and comprises an inner edge region, which comprises the inner surface against which the workpiece rests for tensioning, an outer edge region, which adjoins the cavity, and a disc-shaped intermediate region, which connects the inner edge region to the outer edge region and absorbs the load and force.

5. The tensioning device according to claim 4, wherein the intermediate region is solid or in that the intermediate region comprises multiple spoke-like supporting elements that are evenly distributed around the central axis and extend from the inner edge area to the outer edge area, wherein two adjacent supporting elements, inner edge area and outer edge area surround a free cut that is material-free.

6. The tensioning device according to claim 5, wherein at least one of the multiple spoke-like support elements in a plane transverse to the central axis comprises a cross-section that widens from the inner edge region to the outer edge region and/or in that at least one of the multiple spoke-like support elements in a plane transverse to the central axis comprises a V-type or Y-type cross-section that opens outwards with respect to the central axis.

7. The tensioning device according to claim 5, wherein at least one of the at least one free cut comprises a rounded cross-section in a plane transverse to the central axis and/or comprises rounded corners.

8. The tensioning device according to claim 1, wherein the stop section, the tensioning section and the material weakening sections of the tensioning sleeve form a common one-piece component and/or in that the tensioning sleeve and frame form two separate components or components which are separated from one another.

9. The tensioning device according to claim 1, wherein the frame has a cut-out extending transversely or obliquely to the central axis, which extends from an outer wall of the frame to the inner wall of the frame and which opens into the cavity.

10. The tensioning device according to claim 9, wherein the tensioning means of the tensioning unit comprises a fluid which is introduced into the cavity via the cut-out in the frame and in that the tensioning unit comprises a pressure build-up mechanism by means of which the fluid arranged in the cavity is pressurised, wherein the force acting in the direction of the central axis comprises a compressive force.

11. The tensioning device according to claim 1, wherein at least two sealing mechanisms, which are each arranged between the stop surface of the tensioning sleeve and the inner wall of the frame, which are each designed to be completely circumferential with respect to the central axis and which, viewed in the direction of the central axis, are spaced apart from one another and arranged on opposite sides with respect to the cavity.

12. The tensioning device according to claim 1, wherein at least one ring, tyre or disc-like stopping mechanism, which is fixed to the frame and which protrudes with respect to the inner wall of the frame in the direction of the central axis and limits movement of the tensioning sleeve along a joint direction running parallel to the central axis, along which the tensioning sleeve is inserted into the opening of the frame when arranged in the frame, upon reaching an end position in which the tensioning sleeve is in contact with the step area.

13. The tensioning device according to claim 12, wherein at least one ring, tyre or disc-like rear gripping mechanism, which is detachably fixable or fixed to the frame on the side facing away from the stopping mechanism, which extends in the direction of the central axis and overlaps the tensioning sleeve transversely to the central direction at least in sections and which engages behind the clamping sleeve arranged in the frame to prevent it from moving against the joint direction.

14. The tensioning device according to claim 12, wherein the stopping mechanism and/or the rear gripping mechanism is fixed or secured to the frame in a detachable manner, in particular by means of force-fit and/or form-fit, or in a non-detachable manner, in particular by means of material, force and/or form-fit.

15. The tensioning device according to claim 12, wherein the frame and the stopping mechanism form a common one-piece component.

* * * * *